United States Patent [19]

Salway

[11] 3,965,878

[45] June 29, 1976

[54] SPARK IGNITION SYSTEMS FOR INTERNAL COMBUSTION ENGINES

[75] Inventor: Peter Hugh Salway, Birmingham, England

[73] Assignee: The Lucas Electrical Company Limited, Birmingham, England

[22] Filed: Jan. 10, 1974

[21] Appl. No.: 432,230

[30] Foreign Application Priority Data

Feb. 10, 1973 United Kingdom ..... 6687/73

[52] U.S. Cl. ..... 123/148 E; 315/209 T

[51] Int. Cl.[2] ..... F02P 1/00

[58] Field of Search ..... 123/148 OC, 148 IC, 123/148 E; 315/209 T

[56] References Cited

UNITED STATES PATENTS

| | | | |
|---|---|---|---|
| 3,078,391 | 2/1963 | Bunodiere et al. | 123/148 IC |
| 3,308,801 | 4/1967 | Motto, Jr. | 123/148 IC |
| 3,329,867 | 7/1967 | Stearns | 123/148 OC |
| 3,335,320 | 8/1967 | Quinn | 123/148 OC |
| 3,443,556 | 5/1969 | Vadala | 123/148 IC |
| 3,745,985 | 7/1973 | Hohne | 123/148 E |

*Primary Examiner*—Charles J. Myhre
*Assistant Examiner*—Ronald B. Cox

[57] ABSTRACT

In a spark ignition system it is possible for a vehicle to stall with the contact breaker closed, and for a transistor or other device in series with the ignition coil to conduct heavily. This problem is overcome by limiting the time for which the ignition coil can be energised.

1 Claim, 1 Drawing Figure

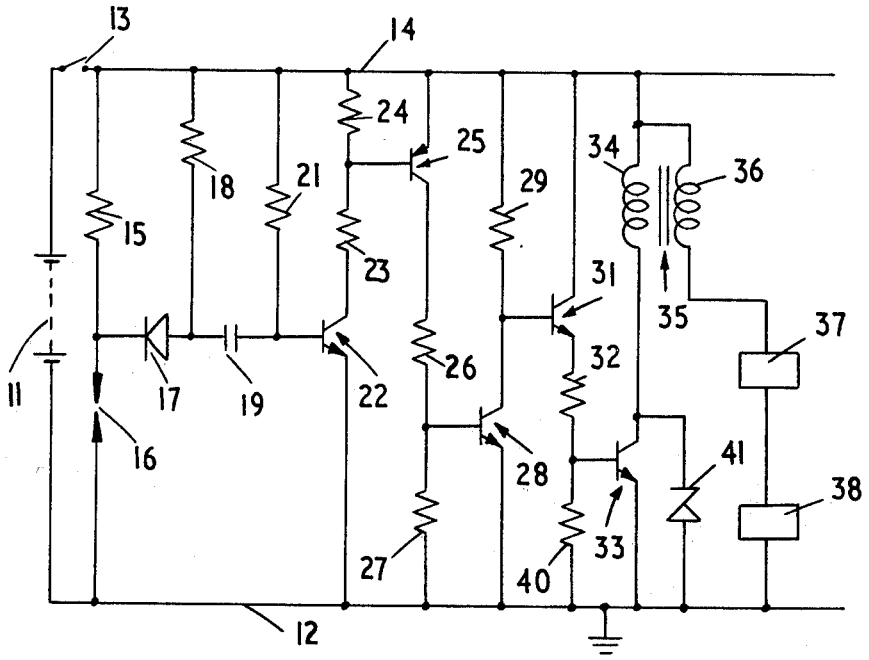
13
14
24
25
34
36
18
21
29
15
23
31
35
37
11
17
19
22
26
32
16
28
41
38
33
27
40
12

SPARK IGNITION SYSTEMS FOR INTERNAL COMBUSTION ENGINES

This invention relates to spark ignition systems for internal combustion engines.

A system according to the invention includes a switching device in series with the primary winding of an ignition coil, means for turning said device on to store energy in the winding and off to produce a spark, and means for restricting the on time of the switching device to a level greater than the maximum normal on time of the device.

The accompanying drawing is a circuit diagram illustrating one example of the invention.

Referring to the drawing, a battery 11 of a road vehicle has its negative terminal connected to a supply line 12 which is earthed, and its positive terminal connected through the ignition switch 13 of the vehicle to a supply line 14. Connected in series between the lines 14, 12 are a resistor 15 and a contact breaker 16 driven by the engine. The junction of the resistor 15 and contact breaker 16 is connected to the line 14 through a diode 17 and a resistor 18 in series, the resistor 18 being bridged by a capacitor 19 and a resistor 21 in series, and the junction of the capacitor 19 and resistor 21 being connected to the base of an n-p-n transistor 22. The transistor 22 has its emitter connected to the line 12, and its collector connected to the line 14 through resistors 23, 24 in series, the junction of the resistors 23, 24 being connected to the base of a p-n-p transistor 25, the emitter of which is connected to the line 14 and the collector of which is connected to the line 12 through resistors 26, 27 in series. The junction of the resistors 26, 27 is connected to the base of an n-p-n transistor 28, the emitter of which is connected to the line 12, and the collector of which is connected to the line 14 through a resistor 29, and is also connected to the base of an n-p-n transistor 31. The transistor 31 has its collector connected to the line 14 and its emitter connected through a resistor 32 to the base of an n-p-n transistor 33, the emitter of which is connected to the line 12 the collector of which is connected to the line 14 through the primary winding 34 of an ignition coil 35, and the base of which is connected through a resistor 40 to the line 12.

The secondary winding 36 of the transformer is connected through a conventional distributor 37 to the spark plugs 38 of the engine in turn, and the collector-emitter of the transistor 33 is bridged by a Zener diode 41.

When the contact breaker 16 is open, current flows through the resistor 21 to turn on the transistor 22, so that the transistors 25 and 28 also turn on and the transistors 31 and 33 are off. This is the state of affairs immediately following the production of a spark. When the contact breaker 16 closes, the current flowing through the resistor 21 flows through the capacitor 19, the diode 17 and the contact breaker 16, so that the transistor 22 turns off, removing base current from the transistors 25 and 28. The current flowing through the resistor 29 now turns on the transistor 31, so that the transistor 33 is turned on and energy is stored in the winding 34.

In normal operation of the circuit, the contact breaker 16 opens again before the capacitor 19 has charged, and at this point current flow to the base of the transistor 22 is restored, and the transistors 25 and 28 turn on, turning off the transistors 31 and 33 so that a spark is produced. The capacitor 19 discharges while the contact breaker 16 is open, and the cycle is repeated when the contact breaker 16 closes again.

If the engine stalls with the contact breaker 16 closed, the capacitor 19 continues to charge, and when it is fully charged base current is restored to the transistor 22, even though the contact breaker 16 is closed. As a result, the transistors 22, 25 and 28 turn on, but the transistors 31 and 33 turn off, producing a single spark. The circuit then remains in a stable state with the contact breaker 16 closed, the transistors 22, 25 and 28 on, but the transistors 31 and 33 off. It will be appreciated that although there is still dissipation of energy within the circuit at this stage, the transistor 33 handles by far the greatest current in the circuit, and so the arrangement ensures that there is a saving in power if the system should stall with the contact breaker 16 closed.

I claim:

1. A spark ignition system for an internal combustion engine, including a battery, an ignition coil having a primary winding of relatively low impedance, a switching transistor in series with said primary winding across said battery, means for turning said transistor on to store energy in the winding and off to produce a spark, said last-mentioned means comprising contact breaker means, a first resistor in series with said contact breaker means across said battery, a second resistor and a diode connected in series between the positive terminal of said battery and the junction between said first resistor and said contact breaker means, a third resistor and a capacitor arranged in parallel to said second resistor, and an input transistor connected to the junction of said third resistor and said capacitor, and to said switching transistor, the arrangement being such that said switching transistor is conductive when said input transistor is conductive and the latter transistor will remain conductive as long as said capacitor charges upon closing of said contact breaker means, while said capacitor discharges via said diode and first resistor upon opening of said contact breaker means.

* * * * *